United States Patent [19]

Moore

[11] 4,154,002

[45] May 15, 1979

[54] DRY CLEANING

[75] Inventor: William F. Moore, Guildford, England

[73] Assignee: Neil and Spencer Limited, England

[21] Appl. No.: 722,095

[22] Filed: Sep. 10, 1976

[30] Foreign Application Priority Data

Sep. 26, 1975 [GB] United Kingdom ..... 39459/75

[51] Int. Cl.[2] ..... F26B 3/04

[52] U.S. Cl. ..... 34/12; 34/27; 34/32; 34/77; 8/142; 68/18 C

[58] Field of Search ..... 8/142; 68/18 C, 18 R, 68/20; 34/27, 32, 54, 77, 78, 12; 220/85 VR, 85 VS; 62/54; 55/88

[56] References Cited

U.S. PATENT DOCUMENTS

| | | | |
|---|---|---|---|
| 2,189,915 | 2/1940 | Mellor et al. | 34/77 |
| 2,910,783 | 11/1959 | Hoyt | 34/77 |
| 3,807,948 | 4/1974 | Moore | 68/18 C |
| 3,831,294 | 8/1974 | Freze | 34/77 |

FOREIGN PATENT DOCUMENTS 2183634 12/1973 France.

*Primary Examiner*—John J. Camby
*Assistant Examiner*—Larry I. Schwartz
*Attorney, Agent, or Firm*—Larson, Taylor and Hinds

[57] ABSTRACT

Dry cleaning of goods using perchloroethylene as solvent, in which during drying and deodorizing operations a flow of air is created by a fan in a closed circuit, vapour of the solvent is condensed solely by a refrigerated condenser, and during deodorizing the flow of air created by the fan is directed through a passage which restricts the flow, whereas during drying, the air is permitted to flow more freely, whereby during deodorizing the flow of air over the condenser is a minor fraction only of the flow of air through the goods during drying.

2 Claims, 1 Drawing Figure

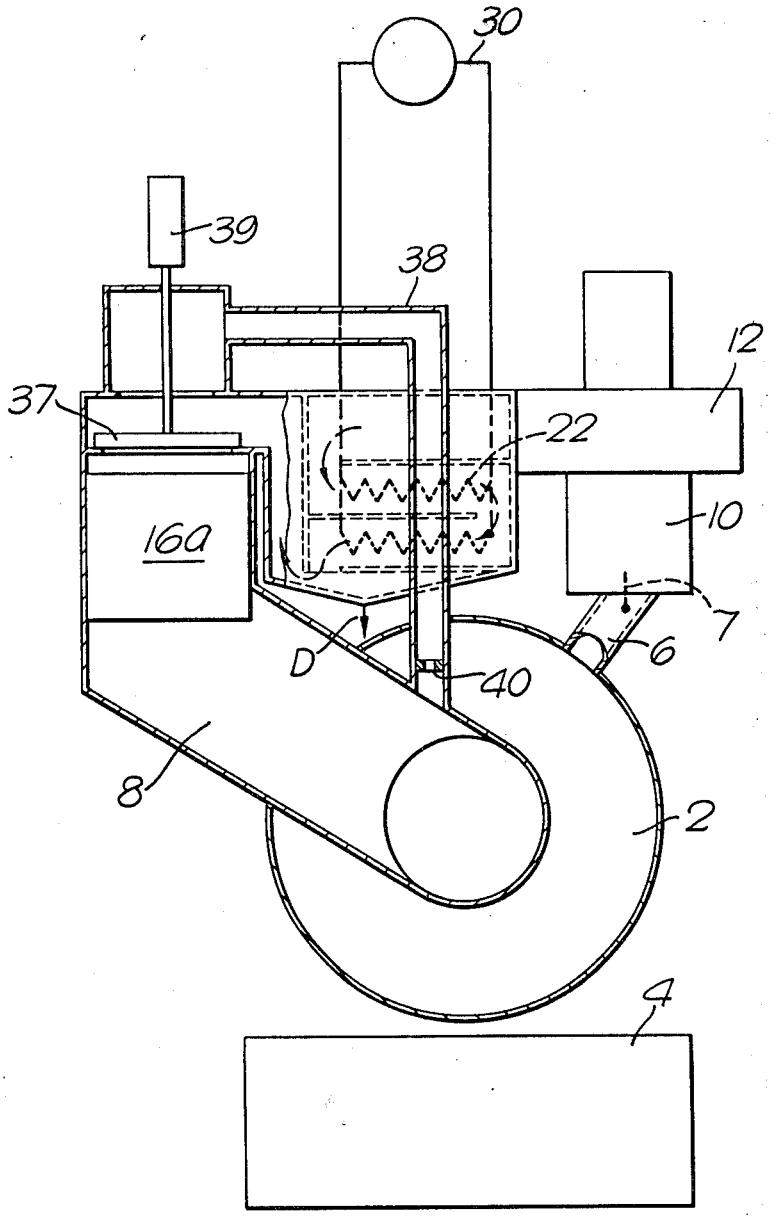
30
39
38
12
37
22
16a
10
7
6
D
40
8
2
4

DRY CLEANING

In the usual process of dry-cleaning, goods, i.e. garments or fabrics, are handled in batches. Each batch is cleaned by agitation in a bath of liquid solvent, and then the solvent is removed from the goods by, firstly draining away the majority of the solvent, secondly centrifuging the goods to extract most of the remaining solvent, and thirdly passing a flow of air through the goods to vaporise and carry off nearly all the last traces of solvent. This solvent in the air is recovered and re-used within the dry cleaning machine. The centrifuging is commonly known as "extraction". The passing of a flow of air is commonly known as "drying". The dry cleaning machine usually includes a rotary basket enclosed in a housing, with connections to the housing for inlet and outlet of liquid solvent and for inlet and outlet of air. For each batch of goods the machine performs a cycle of operations, starting with loading of goods into the basket and finishing with unloading.

This invention concerns improved dry-cleaning processes in which the solvent used is perchloroethylene ($Cl_2C{=}CCl_2$, boiling point 121° C.), and also concerns machines for carrying out such improved processes. Hitherto, when perchloroethylene has been used, drying has commonly been carried out by circulating air, by means of a fan, through the goods in the basket and through a water-cooled condenser and a heating element.

The water-cooled condenser recovers most of the solvent from the air, but there is still a small amount of solvent in the goods and in the air in the machine, which would give the goods an odour, and to deal with this there is a final operation known as deodorising.

The most usual procedure for deodorising has been to slightly open the door of the housing or to automatically open an air entry valve, to operate the same fan as is used for drying, and to open a connection to a vent, leading to atmosphere. This causes a flow of fresh air into the housing, which displaces the solvent-laden air present in the housing and itself flows through the goods in the basket. This has the disadvantage that there is some loss of solvent through the vent to the atmosphere. Furthermore, the discharge of perchloroethylene to the atmosphere may be regarded as objectionable.

A modified procedure is to pass the air to the vent through a carbon recovery plant in which the solvent is adsorbed. From time to time the solvent is expelled from the carbon recovery plant with the aid of steam and is recovered.

According to the present invention dry-cleaning is carried out using perchloroethylene as solvent, and during drying and deodorising operations a flow of air in a closed circuit is created by a fan, the vapour of the solvent is condensed solely by a refrigerated condenser, and during deodorising, the flow of air created by the fan is directed through a passage which restricts the flow, whereas during drying, the air is permitted to flow more freely whereby during deodorising the flow of air over the condenser is a minor fraction only of the flow of air through the goods during drying.

An example of a machine suitable for carrying out the present invention will now be described with reference to the accompanying drawings, in which the single FIGURE is a circuit diagram of the machine.

The machine includes a customary housing 2 containing a rotary basket (not shown). The circuit for drying of goods at the conclusion of centrifuging is constituted by ducting running from an outlet 6 from the housing to an inlet 8, and containing a dust filter 10, a fan 12, a refrigerated condenser element 22 with external fins, and a heater 16*a*.

The machine is operated using perchloroethylene as solvent. The operation is in cycles, one cycle for each batch of goods. Refrigerant at a temperature in the range −30° C. to −35° C. is circulated through the interior of the condenser element throughout operation of the machine. At the start of a cycle, the condenser element 22 will be in an iced-up condition, covered with a solid which is a mixture of water and solvent. After cleaning, draining, and centrifuging, a drying operation can commence, the condenser element being still iced-up.

At the start of the drying operation, the fan 12 is started, and the heater 16*a* is turned on. In consequence, a flow of warm air at about 100° to 105° C. passes at 8 from the heater to the housing 2. This air gives up heat to the solvent in the goods in the basket, to produce evaporation. Air, partially saturated with solvent, leaves the housing at 6. The air temperature at 6 rises to 60° C., and is held at that value by a thermostat 7 at 6, controlling the heater 16*a*. This air from the outlet 6 (after passing through the filter 10 and fan 12) then flows over the condenser element 22, with the result that the temperature of the air falls, and much of the solvent in the air is condensed, while at the same time the ice on the condenser element progressively melts. Liquid, consisting of a mixture of water and solvent, is collected at D, and conveyed to a water separator (not shown) from which liquid solvent passes to the tank 4. Until the condenser element is de-iced, the air arriving at the heater 16*a* is at a temperature in the neighbourhood of 0° C. Thereafter the air arriving at the heater is at about +10° C.

Operation of the fan 12 continues until substantially no liquid solvent remains in the goods in the housing 2. This stage represents the end of drying and the start of deodorising.

At the end of drying, a disc-shaped damper 37 is moved downwards by an actuator 39 to close the entrance to the heater 16*a* and open an entrance to a passage 38 restricted by an orifice 40. Although the end of drying can be detected by detecting when liquid flow at D ceases, it is convenient in a commercial machine to operate the damper 37 after lapse of a predetermined time. Because of the retention of heat in the goods and in the metal of the machine, the heater 16*a* is turned off about 5 minutes before the end of drying.

During deodorising, the fan continues to operate at the same speed as before, but the passage 38 imposes a substantial restriction on the flow of air, so that, during deodorising, the flow of air through the fan 12, over the condenser element 22 and through the passage 38 is a small fraction of what the flow of air was during drying. For example, the air flow may be reduced from 250 cu. ft/min (7 cu.m/min) to 25 cu.ft/min (0.7 cu.m/min), in a machine handling 25 lbs (11.4 Kg) of goods per load, by using an orifice 40 of diameter 1.5 inch (38 mm). As an alternative to the use of an orifice 40, the entire passage 38 may be of sufficiently small bore to impose the desired restriction on air flow.

The temperature of the fins of the condenser element throughout deodorising is maintained at about −20° C.

The effect of the condenser element 22 is then to reduce progressively the solvent content of the body of air circulating in the machine, with a consequential reduction in the amount of solvent vapour present in air spaces in the goods. Throughout deodorising, which continues for 3 to 5 minutes, the temperature of air leaving the condenser element is about −15° C. This corresponds to an exceedingly small solvent vapour content (about 0.02 ounces of perchloroethylene per cubic foot of air (equals 20 grams per cubic meter)) in the air leaving the condenser element. During the time allowed for deodorising, the solvent content in the air in the housing 2 falls until it approximates to this value, and the goods are then in what is considered a deodorised condition, and are ready to be unloaded from the basket.

During the deodorising, the condenser element becomes progressively iced-up. This is not harmful provided adequate passages remain for flow of air. The iced-up condition is a positive advantage in the early part of the following cycle of operations, because the ice, in the course of being melted, serves as a heat sink whereby heat is taken up from condensing solvent at a greater rate than heat is being removed from the element 22 by the refrigerant within the element. Consequently the rate of condensation of solvent is high in the early part of each drying operation, and this circumstance contributes to the speed of the total cycle.

The flow of air through the housing 8 during drying is determined by the size and speed of the fan 12, and is designed to be sufficient to cause agitation of the goods (additional to the tumbling caused by rotation of the basket). Such agitation is desirable, in order to physically release solvent vapour from the goods during drying. On the other hand, the flow of air over the condenser element during deodorising is designed to be sufficiently low so that there is only a small difference between the temperature of the refrigerant within the condenser element and the temperature of the air as it leaves the condenser element. In this way the minimum temperature reached by the air can be brought down to a value at which the amount of solvent vapour remaining uncondensed is exceedingly small. The deodorising continues until the total flow of air over the condenser has amounted to several times the total volume of air in the apparatus. By this means the solvent vapour content of the air in the housing is progressively reduced until it approximates to the value found in the air leaving the condenser element. It should be noted that this operation does not necessitate reducing the temperature of all the air in the apparatus simultaneously to a temperature equal to that of the air flow leaving the condenser element.

If the flow of air over the condenser were extremely low, the deodorising would take an unduly long time. The actual flow of air over the condenser is thus a compromise, designed to attain, in a reasonable time, a satisfactorily low solvent vapour content in the air in the housing.

Exact measurement of air flow within a dry cleaning machine is difficult, but we believe that good results are attained when, during deodorising, the flow of air over the condenser is between 10 and 20% of the flow of air through the goods during drying.

It may be desirable for the refrigeration circuit 30, by which the element 22 is cooled, to be capable of being set to produce either of two pressures of the refrigerant within the element 22. If that arrangement is made, then the lower pressure is set during the drying and the higher pressure is set during the deodorising. This means that there is unlikely to be cutting-out of the refrigerant compressor during deodorising.

Although occasionally dry-cleaning machines have previously been operated with perchloroethylene as solvent and with condensation by means of a refrigerated condenser, these machines have been constructed to pass the air flow at the same rate during drying and deodorising, and it has been found that the solvent vapour content in the air in the drum was not reduced to a level such that the goods could be regarded as deodorised.

The fact that, in the present invention, the flow of air over the condenser during deodorising is only a minor fraction of the flow of air through the goods during drying enables the minimum air temperature attained to be markedly lower than in any previous apparatus, and hence enables the solvent vapour content to be reduced, solely by condensation in a closed system, to a value which produces acceptable deodorising.

I claim:

1. A method of drying and deodorizing goods after dry cleaning using perchloroethylene as solvent, said method including drying and deodorizing operations and comprising the steps of:

(a) creating by a fan a flow of air in a closed circuit through said goods during said drying and deodorizing operations, (b) heating said flow of air prior to reaching said goods, during said drying operation, (c) condensing solvent vapour from said flow of air solely by means of a refrigerated condenser, and (d) during the deodorizing operation, directing the flow of air created by the fan through a passage which restricts the flow and, during the drying operation, permitting the air to flow more freely such that the flow of air over said condenser during said deodorizing operation is a minor fraction only of the flow of air through said goods during said drying operation.

2. Dry cleaning apparatus for dry cleaning goods using perchloroethylene as solvent, said apparatus comprising a housing, means defining a closed circuit for air leading from said housing through a fan, a condenser and a heater and back to said housing and permitting a predetermined maximum air flow, said condenser containing a refrigerated condenser surface for condensing solvent vapour from the air flowing in said circuit, and a passage bypassing said heater and imposing a restriction on air flow, and at least one damper for enabling flow through said heater to be stopped so that a minor fraction only of the maximum air flow then passes through said fan and said condenser.

* * * * *